United States Patent [19]

Salzgeber et al.

[11] 4,046,494

[45] Sept. 6, 1977

[54] FUEL INJECTION PUMP AND REPLACEABLE CHECK VALVE THEREFOR

[75] Inventors: Daniel Edwin Salzgeber, Windsor; Robert Raufeisen; Charles W. Davis, both of Simsbury, all of Conn.

[73] Assignee: Stanadyne, Inc., Hartford, Conn.

[21] Appl. No.: 606,058

[22] Filed: Aug. 20, 1975

[51] Int. Cl.[2] ..... F04B 25/00; F04B 29/00; F04B 27/08

[52] U.S. Cl. ..... 417/253; 417/462; 137/454.4

[58] Field of Search ..... 417/506, 462, 253; 137/454.4

[56] References Cited

U.S. PATENT DOCUMENTS

| | | | |
|---|---|---|---|
| 2,109,785 | 3/1938 | Starr | 137/454.4 |
| 3,455,585 | 7/1969 | Raymond | 417/269 |
| 3,603,705 | 9/1971 | Chandraratna | 417/253 |
| 3,664,773 | 5/1972 | Drori | 417/507 |
| 3,861,833 | 1/1975 | Salzgeber et al. | 417/462 |

*Primary Examiner*—William L. Freeh
*Attorney, Agent, or Firm*—Prutzman, Hayes, Kalb & Chilton

[57] ABSTRACT

This invention relates to improved fuel injection apparatus for compression-ignition engines and the like and more particularly to a novel and improved check valve arrangement for a rotary distributor fuel injection pump of the type employed for the delivery of a measured amount of fuel to each of the cylinders of an associated internal combustion engine.

6 Claims, 2 Drawing Figures

FUEL INJECTION PUMP AND REPLACEABLE CHECK VALVE THEREFOR

Figure 1:
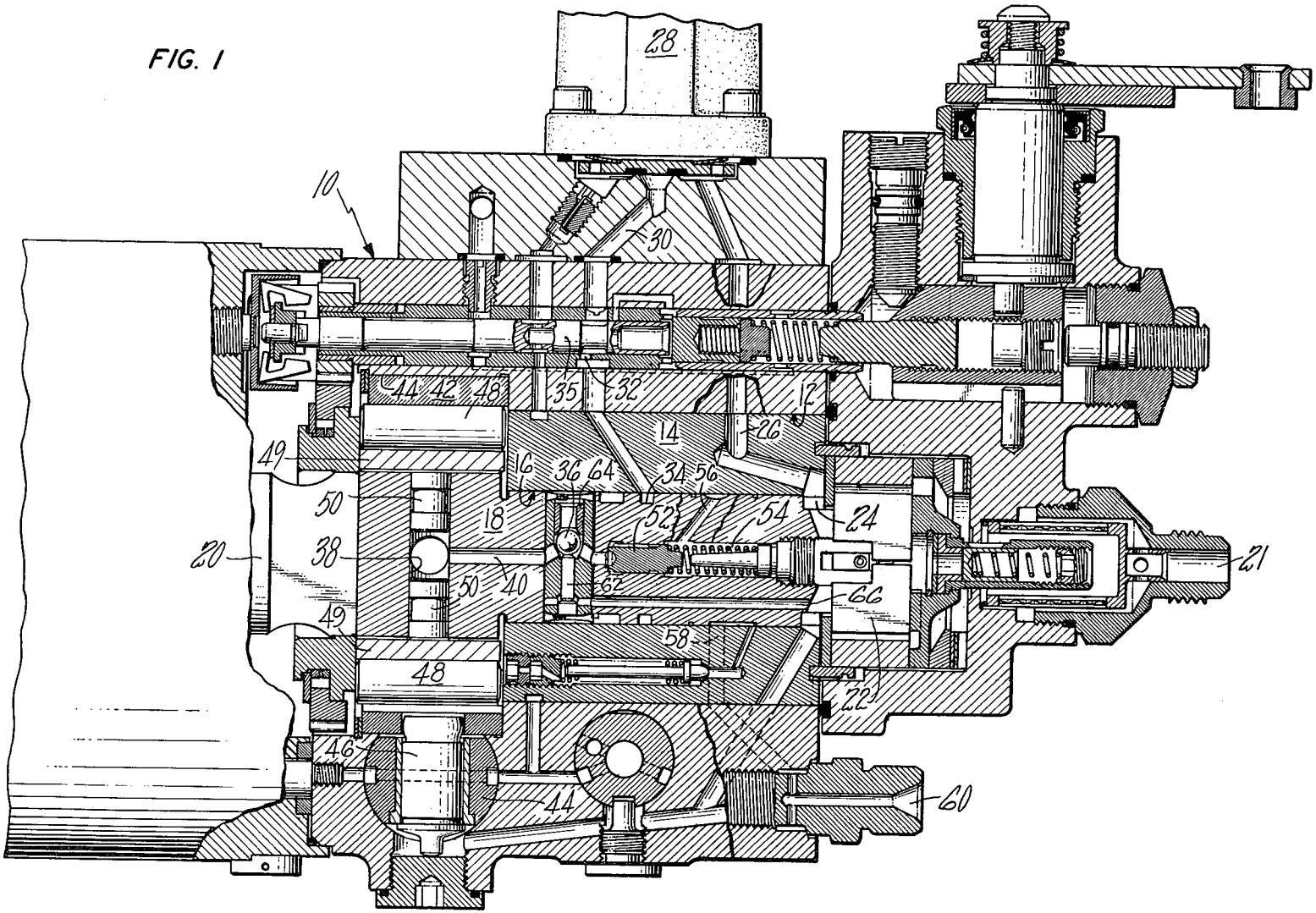

An object of this invention is to provide an improved fuel pump incorporating an easily replaceable rotor mounted check valve in the inlet fuel line of the injection pump.

A further object of the invention is to provide a prefabricated unitary check valve cartridge which is easy to remove and replace. Included in this object is the provision of such a cartridge which is assembled on the rotor in such a manner as to minimize the stresses imposed on the rotor by its assembly and during use.

Another object of the invention is to provide a novel arrangement for maintaining check valve cartridge in its assembled position on the rotor.

Other objects will be in part obvious and in part pointed out more in detail hereinafter.

A better understanding of the invention will be obtained from the following detailed description and the accompanying drawings of an illustrative application of the invention.

Figure 2:
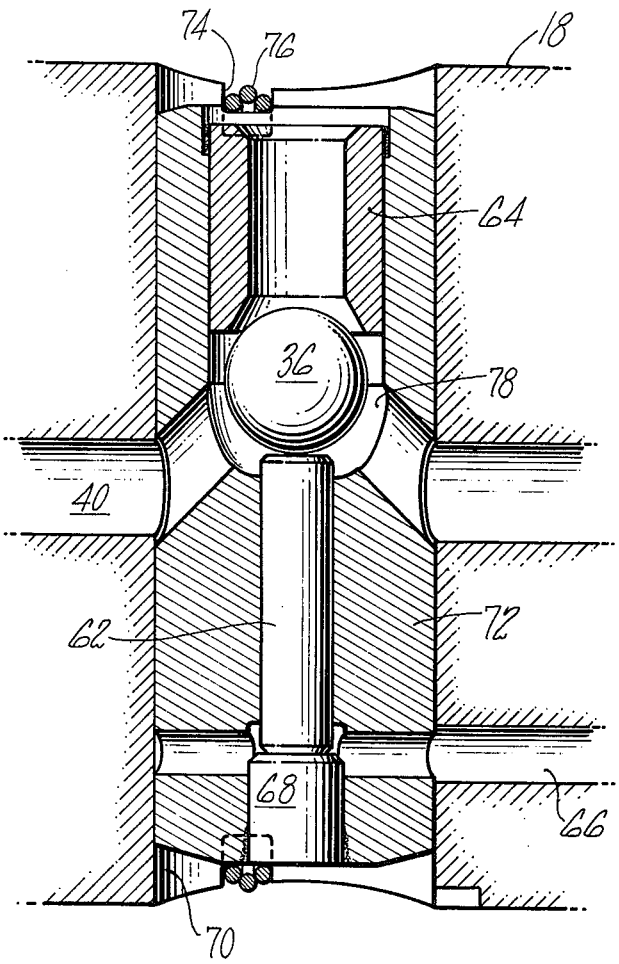

In the drawings:

FIG. 1 is a cross-sectional view of an exemplary fuel injection pump incorporating the present invention; and FIG. 2 is an enlarged fragmentary cross-sectional view of the check valve cartridge assembled of the rotor.

Referring now to the drawings in detail, an exemplary pump incorporating the present invention is illustrated. The pump has a hydraulic head 10 with a cylindrical bore 12 in which a sleeve 14 is tightly received. The sleeve 14 in turn provides a cylindrical bore 16 in which a distributor rotor 18 is journaled for rotation by a drive shaft 20 connected to an associated engine (not shown).

Briefly stated, fuel from a supply tank (not shown) is delivered to the pump inlet 21 to a vane type positive displacement low pressure transfer or supply pump 22, the output of which is pressurized at a pressure correlated with engine speed. Such output is delivered to a large annular groove 24 through passage 26 and past electric shut-off valve 28 which serves to shut off fuel delivered to the pump independent of governor operation. From the shut-off valve 28, the fuel flows through a passage 30 and a metering port 32 to an annulus 34 formed on the periphery of the distributor rotor with the metered fuel pressure in the annulus 34 having a pressure regulated by the metering valve 35. From the annulus 34 and by means of additional passages (not shown), the fuel flows past a one-way ball check valve 36 and through axial passage 40 to pump chamber 38 in a manner such as is more fully described in U.S. Pat. No. 3,861,833.

The pump chamber 38 is being formed by a pair of intersecting transfer bores of an enlarged portion of the rotor. A pair of opposed plungers 50 are mounted for reciprocating movement in each bore.

Surrounding the distributor rotor 18 is a generally annular cam ring 42 which is journaled in a cylindrical recess 44 for limited arcuate movement and is disposed in the plane of revolution of the plungers 50. The cam ring 42 is restrained from rotating by an adjustable timing advance piston 44 and a connecting pin 46 which interconnects the advance piston and the cam ring 42.

Cam rollers 48 and cam roller shoes 49 are carried by the rotor between the plungers 50 and the cam ring.

When a metered charge of fuel is admitted to the pump chamber 38, the plungers 50 move radially outwardly as required to receive the charge of fuel delivered to the pump chamber 38. At this time, the cam rollers 48 are positioned between adjacent cam lobes of cam ring 42. Continued rotation of the rotor 18 then causes the rollers 48 to pass over the cam lobes of the cam ring 42 to translate the profile of the cam lobes into reciprocating motion of the plungers to pressurize the charge of fuel in the pump chamber 38 on the inward strokes of the plungers 50.

The fuel is pressurized to a high pressure, say, up to 12,000 psi in chamber 38, and is delivered through passage 40, past delivery valve 52, the delivery chamber 54. From the delivery chamber 54, pressurized fuel flows through diagonal distributing passage 56 which registers sequentially with a plurality of passages 58 to the outlets 60 for sequential delivery to the injector for each of the several cylinders of the associated engine.

As soon as the measured charge of fuel is delivered to pump chamber 38 through passage 40, the pressure in passage 40 decreases and the inlet ball check closure piston 62 moves upwardly to seat the ball 36 on seal 64 due to the hydraulic pressure in passage 66 which is in continuous communication with the pressurized output of inlet pump 22. Such seating of the ball 36 takes place prior to the rotation of the rollers 48 up cam lobe of cam ring 42 and the resulting pressurization of the fuel in chamber 38. By such positive closure of the ball 36 prior to the pumping stroke, it is apparent that the sharp repetitive loads of high intensity, which would otherwise seat the ball 36 are avoided so that the ball 36 is not damaged by repeated hammering against the valve seat 64. This positive seating of the ball 36 also isolates the fuel in the interior of rotor 18 before it is pressurized to prevent any such leakage of the measured charge of fuel. Since the amount of such leakage would depend upon the distance the ball 36 is displaced from its seat, the positive seating of the ball 36 prevents variation in the intended output of high pressure fuel.

The diameter of the closure piston 62 is smaller than seating diameter of the ball 36 so that if supply pump output pressure is used to positively feed the measured charge of fuel into pump chamber 38 during the charge stroke as disclosed in U.S. Pat. No. 3,861,833, the closure piston 62 does not prevent the opening motion of the ball 36 and the charging flow is permitted. It will be apparent that the closure piston 62 will be subjected to the high pressure in the pump chamber 38 and passage 40 during the pumping stroke so that it strikes its seat during each pumping stroke with high impact.

In accordance with this invention, the ball 36, valve seat 64, closure piston 62 and its stop 68 and the barrel 72 of the cartridge are formed as a prefabricated unit which is mounted in a transverse bore 70 of the distributor rotor 18 with a close sliding fit which does not cause distortion of the rotor such as could result from the use of a press-fit. Moreover, since the stop 68 for the closure piston 62, and the seat 64 for the ball 36, are secured to the ends of the cartridge barrel 72 as by welding, they are held against relative axial movement when the fuel in passage 40 is highly pressurized by the tensile force on the intermediate portion of the barrel 72 of the cartridge. Thus the radial forces tending to separate valve seat 64 and stop 68 are not imposed on the rotor 18 as would occur if the valve seat 64 and the closure piston seat 68 were independently restrained against such movement with respect to each other by being secured directly to the rotor.

Leakage from the axial passage 40 of the rotor 18 between the barrel of the cartridge 72 and the transverse bore 70 of the rotor is minimized because of the long leakage path provided and because of the close machining tolerances of these parts which is, say, limited to about 50 millionths of an inch.

As shown in FIGS. 1 and 2, a groove 74 is formed in the ends of the cartridge and around the periphery of the rotor 18. A spring retaining band 76 having a natural diameter when relaxed of less than the diameter of the groove 74 is positioned in the groove to resiliently hold the cartridge in a centered position with respect to the axis of the rotor 18. The spring retaining band 76 comprises a plurality of convolutions of spring wire with three such convolutions being shown in the drawings. It will be noted that the diameter of the wire forming the spring retaining band 76 is such that the convolutions will more than span the width of the groove 74 thereby to wedge or bias the convolutions against each other for frictional engagement and to maintain the portion of the groove 74 in the cartridge in alignment with the portion of the groove 74 formed in the rotor 18 thereby to secure the cartridge against angular movement in the transverse bore 70 of the distributor rotor 18. It will be noted that the spring retaining band 76 resiliently secures the cartridge against axial movement in the bore 70 and thus serves to dampen any shock impact which occurs when the closure piston 62 impacts its stop 68.

To change the ball check cartridge, all that is required is to remove the rotor 18 from the pump, enlarge the convolutions of the spring retaining band 76 to move the band out of the groove 74 axially along the outside of the rotor 18, slide the ball check cartridge out of the transverse bore 70 of rotor 18, replace it with a new cartridge and return the spring retaining band to its normal position in groove 74.

Thus this invention makes it possible to use a factory built and tested preassembled ball check cartridge which is easily replaced in the field thereby to assure the proper seating of the ball 36 with its seat 64 and the proper functioning of the check valve.

As will be apparent to persons skilled in the art, various modifications, adaptations and variations can be made from the foregoing specific disclosure without departing from the teachings of the present invention.

We claim:

1. A liquid fuel injection pump for supplying measured charges of fuel to an internal combustion engine comprising a distributor rotor having a transverse bore extending therethrough and a pump chamber in which the charges are pressurized to high pressure for injection into the cylinders of said engine, a transfer pump, a passage for delivering the output of said transfer pump to said pump chamber through said transverse bore, and a replaceable check valve cartridge slidably mounted in said transverse bore, said check valve cartridge comprising a prefabricated integral check valve assembly comprising a cylindrical barrel having a single diameter, a hollow valve seat secured to said barrel at one end thereof, a stop secured to the barrel at the other end thereof, a ball for seating on said valve seat, a chamber in said barrel between said valve seat and said stop, a closure piston slidably mounted within said stop and engageable with said ball for seating the ball following the filling stroke of the pump chamber, means for connecting the output of said transfer pump to a cavity at the end of said piston to urge the piston in a direction to seat the ball and means engaging both ends of said barrel for removably retaining said cartridge in said transverse bore without transmitting any transverse forces to said distributor rotor.

2. The liquid fuel injection pump of claim 1 wherein said hollow valve seat and said stop are permanently secured to said barrel.

3. The liquid fuel injection pump of claim 1 wherein said distributor rotor and the ends of said cartridge are provided with an aligned peripheral groove and the securing means comprises a resilient spring retainer positioned in said groove.

4. The liquid fuel injection pump of claim 3 wherein said resilient spring retainer comprises a plurality of convolutions of wire having a diameter when relaxed which is less than the diameter of said groove and the length of the spring retainer is greater than the width of the slot whereby at least one of the convolutions may not engage the bottom of the slot when installed therein thereby to wedge the end convolutions of the retainer against the side walls of the slot.

5. For use in a liquid fuel injection pump for supplying measured charges of fuel to an internal combustion engine and having a distributor rotor with a transverse bore extending therethrough, a replaceable check valve cartridge suited for being slidably mounted in said bore, said check valve cartridge comprising a prefabricated unitary check valve assembly having a cylindrical barrel having a single diameter, a hollow valve seat secured to said barrel at one end thereof, a stop secured to the barrel at the other end thereof, a ball suited for seating on said valve seat, a closure piston slidably mounted within an axial bore of said stop to engage said ball to seat said ball on said valve seat, a cavity within said barrel adapted to receive a pressurized liquid to urge the piston in a direction to seat said ball on said valve seat, and a chamber in said barrel between said valve seat and said stop so that any transverse force resulting from the hydraulic pressure on the fuel within said chamber is fully supported by the walls of said barrel and is not transmitted to the distributor rotor.

6. A device as recited in claim 5 wherein said valve seat and said stop are permanently secured to said barrel.

* * * * *